US005983464A

United States Patent [19]

Bauer

[11] Patent Number: 5,983,464

[45] Date of Patent: Nov. 16, 1999

[54] MAGNETIC FASTENER

[76] Inventor: Irving Bauer, Rte. 4, Box Y23, Mount Kisco, N.Y. 10549

[21] Appl. No.: 08/991,931

[22] Filed: Dec. 16, 1997

[51] Int. Cl.[6] ..... A44B 21/00; H01F 7/00

[52] U.S. Cl. ..... 24/303; 292/251.5

[58] Field of Search ..... 24/303, 66.1; 292/251.5

[56] References Cited

U.S. PATENT DOCUMENTS

| | | | |
|---|---|---|---|
| D. 247,467 | 3/1978 | Morita | D8/331 |
| D. 247,468 | 3/1978 | Morita | D8/331 |
| 4,021,891 | 5/1977 | Morita | 24/201 B |
| 4,200,852 | 4/1980 | Aoki | 335/285 |
| 4,480,361 | 11/1984 | Morita | 24/303 |
| 4,700,436 | 10/1987 | Morita | 24/303 |
| 5,125,134 | 6/1992 | Morita | 24/303 |
| 5,142,746 | 9/1992 | Morita | 24/303 |
| 5,249,338 | 10/1993 | Aoki | 24/303 |
| 5,251,362 | 10/1993 | Riceman et al. | 24/303 |
| 5,274,889 | 1/1994 | Morita | 24/303 |
| 5,349,725 | 9/1994 | Levy | 24/303 |
| 5,367,891 | 11/1994 | Furuyama | 63/29.2 |
| 5,369,899 | 12/1994 | Reeves | 40/1.5 |
| 5,370,582 | 12/1994 | Campbell | 464/170 |
| 5,377,392 | 1/1995 | Morita | 24/303 |
| 5,379,495 | 1/1995 | Riceman et al. | 24/305 |
| 5,392,497 | 2/1995 | Defner | 24/303 |
| 5,400,479 | 3/1995 | Medina et al. | 24/303 |
| 5,409,275 | 4/1995 | Yoshida et al. | 292/251.5 |
| 5,425,160 | 6/1995 | Krapf | 24/67 R |
| 5,428,873 | 7/1995 | Hitchcock et al. | 24/303 |
| 5,432,986 | 7/1995 | Sexton | 24/303 |
| 5,448,806 | 9/1995 | Riceman et al. | 24/303 |
| 5,450,658 | 9/1995 | Hicks | 24/303 |
| 5,473,799 | 12/1995 | Aoki | 24/303 |
| 5,515,581 | 5/1996 | Kaufmann | 24/303 |
| 5,518,784 | 5/1996 | Fussell | 428/7 |
| 5,541,790 | 7/1996 | Bleeke | 360/105 |
| 5,545,157 | 8/1996 | Van Iten | 604/385.1 |
| 5,560,089 | 10/1996 | Morita | 24/303 |
| 5,572,772 | 11/1996 | Morita | 24/303 |
| 5,572,773 | 11/1996 | Bauer | 24/303 |
| 5,572,887 | 11/1996 | Geswelli | 63/3 |
| 5,604,960 | 2/1997 | Good | 24/303 |
| 5,611,120 | 3/1997 | Riceman et al. | 24/303 |
| 5,611,689 | 3/1997 | Stemmann | 433/189 |
| 5,618,071 | 4/1997 | Aoki | 292/251.5 |
| 5,630,258 | 5/1997 | Schneider | 24/303 |
| 5,647,101 | 7/1997 | Morita | 24/303 |
| 5,675,874 | 10/1997 | Chen | 24/303 |
| 5,676,600 | 10/1997 | Campbell | 464/170 |
| B1 4,021,891 | 8/1986 | Morita | 24/303 |
| B1 4,453,294 | 5/1991 | Morita | 24/303 |
| B2 4,021,891 | 9/1987 | Morita | 24/303 |
| B2 4,453,294 | 7/1996 | Morita | 24/303 |

*Primary Examiner*—Victor N. Sakran
*Attorney, Agent, or Firm*—Abelman, Frayne & Schwab

[57] ABSTRACT

A magnetic fastener is provided, of the type which finds particular utility as a closure for a handbag flap. It includes cooperating male and female assemblies. The female assembly, which includes a permanent magnet, is intended to be secured to the main body portion of the handbag or other article which will be using the magnetic fastener as a closure. Both the female and male assemblies include a ferromagnetic member, having a planar portion. The permanent magnet includes a central opening which is configured to receive a central projecting ferromagnetic portion of the male assembly. The permanent magnet is substantially enclosed by non-ferromagnetic material which preferably provides a substantial, preferably dual, layer of non-ferromagnetic insulation material over at least a major portion of the permanent magnet's peripheral wall surfaces. The non-ferromagnetic enclosure may include an outermost piece which is snap fit over the other previously assembled portions of the female assembly. The outermost surfaces of the enclosure may be formed of a material (such as molded plastic) which may be colored and/or otherwise decorated to provide aesthetics which are coordinated with respect to the handbag or other article to which the fastener is attached.

40 Claims, 7 Drawing Sheets

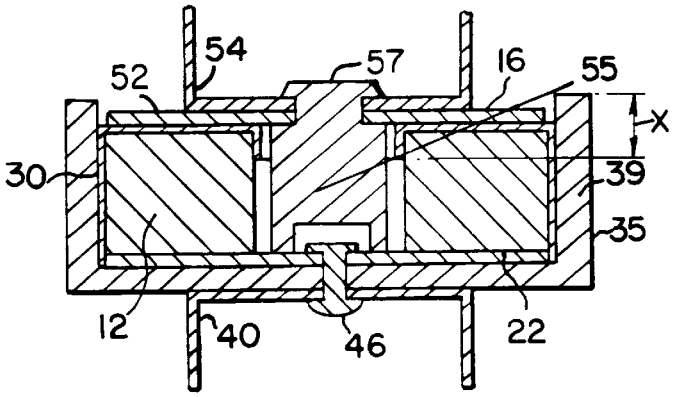
FIG.4
FIG. 6
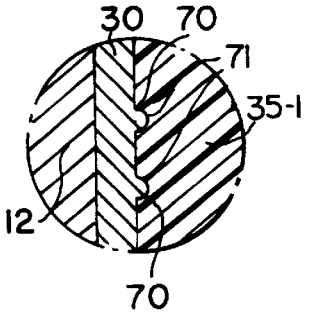
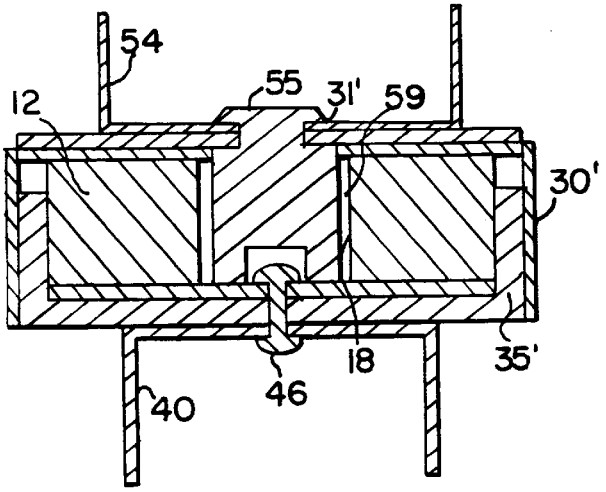
FIG.7
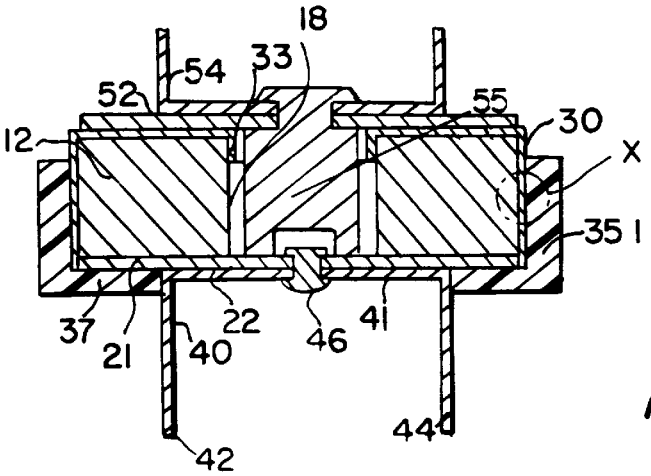
FIG.5

MAGNETIC FASTENER

FIELD OF INVENTION

The present invention relates to a magnetic fastener which utilizes the attractive forces of a permanent magnet to provide a closure which has found particular utility in conjunction with handbags.

BACKGROUND OF THE INVENTION

The present fastener is of the general type shown in U.S. Pat. Nos. 4,021,891; 4,453,294; and 5,274,889. Such magnetic fasteners includes cooperating female and male member assemblies. The female member includes a permanent magnet, a ferromagnetic member at one of its poles and appropriate cover means for protectively enclosing the permanent magnet and controlling the magnetic flux paths. The male member assembly includes a cooperating ferromagnetic member which will be magnetically attracted to the female member assembly. To provide for proper positioning and centering of the inter-engaged male and female member assemblies, the permanent magnet of the female assembly includes a central opening for receiving, and appropriately positioning, a projecting ferromagnetic portion of the male member assembly. In order to (a) appropriately protect the magnet from damage, (b) provide an aesthetically pleasing overall surface appearance, and (c) of particular importance, control the flux paths, it has been the general practice to enclose the female member assembly in external metal or other surface coverings which may include ferromagnetic and non-ferromagnetic portions. Such enclosure members may typically be formed of brass or brass plated non-ferromagnetic metal. The particular selection and configuration of the ferromagnetic and non-ferromagnetic portions has varied in accordance with the particular requirements and design of the particular fastener. By and large, the prior art magnetic fasteners have generally included a cover enclosure which extends over the major surface of the permanent magnet and which is generally visible on the surface of the handbag or accessories to which the female portion is affixed. Although widely successful, fasteners of this type may cause some erasure of magnetic encoding on credit cards or the like which are stored in handbags. Although some prior workers have attempted to address this problem, the solutions have not met with wide commercial acceptance.

SUMMARY OF THE INVENTION

The magnetic fastener according to the present invention includes an improved assembly for the female member. The female member includes a permanent magnet having opposed first and second poles, and a central opening interiorally extending between the opposed poles. A first, preferably planar, ferromagnetic member is positioned against the first pole. Non-ferromagnetic materials are utilized to cover substantially the entire exterior surface of the permanent magnet and its associated planar ferromagnetic member. Several embodiments are disclosed for achieving the advantageous results of the present invention. An advantageous feature of all is the provision of an extra thickness of non-ferromagnetic material in selected areas. This may be accomplished by the utilization of two layers of non-ferromagnetic material covering at least a major portion of the circumferential peripheral walls of the permanent magnet. Alternatively it can be a sufficiently thick single layer of non-ferromagnetic material to provide the requisite spacing between the permanent magnet and exterior of the fastener, to achieve the desired higher amount of magnetic insulation. The increased amount of magnetic insulation serves to substantially closely confine the path of the magnetic flux lines about the permanent magnet, thereby minimizing the possibility of leakage flux from damaging the magnetic strip of credit cards or other magnetically sensitive materials that may be placed within the user's handbag, to which the magnetic fastener is attached.

In accordance with a particularly advantageous feature of the present invention, the exterior portion of the non-ferromagnetic covering for the female member may be formed of plastic material, which will be of a color, or otherwise decorated, to provide enhanced aesthetic coordination with the article (e.g., handbag) to which it is attached. This is to be contrasted with the prior art which generally provided for a brass closure member which is not apt to be aesthetically harmonious with the material forming the article to which it is attached. Advantageously, the plastic material forming this non-ferromagnetic enclosure may have embedded therein flux blocking particles (e.g., zinc or a zinc/nickel composite) to provide further magnetic insulation.

In accordance with a further advantage present in several of the embodiments, the individual parts forming the female assembly include complementary projections and recesses which may be snap fit together, thereby avoiding the need for rivets or other similar fastening members.

In order to enhance the versatility of the aesthetic compatibility between the magnetic fastener and the article to which it is attached, the non-ferromagnetic closure member may be snap fit over the other previously assembled portions of the female assembly. This will readily permit customizing of the magnetic closure to be appropriately color coordinated with the particular article to which it is to be attached.

According to a preferred embodiment of the present invention, the female assembly comprises a circular permanent magnet, a substantially planar ferromagnetic member, and two cup-like non-ferromagnetic members. The circular permanent magnet includes a central opening, and opposed upper and lower polar surfaces. The planar ferromagnetic member is positioned against the lower polar surface of the permanent magnet. Each of the cup-like non-ferromagnetic members includes a planar portion and a circumferential wall portion. The planar portion of one of the cup-like members is exteriorly positioned below the ferromagnetic member, with its peripheral walls extending along the outer periphery of the permanent magnet, towards its upper pole. Thus, the planar ferromagnetic member will be enclosed within this first cup-like non-ferromagnetic member. The other non-ferromagnetic cup-like member is positioned against the upper pole of the magnet, except for a portion of the permanent magnet central opening, with its circumferential portion extending downward along the peripheral wall of the magnet towards its lower pole surface. There will be a desired degree of overlap between the peripheral walls of the two cup-like members so as to provide a double layer of non-ferromagnetic insulation between the outer periphery of the permanent magnet and its surroundings. The materials forming the non-ferromagnetic cup-like members may be varied. Although the upper non-ferromagnetic member may typically be formed of brass, it may alternatively be a non-ferromagnetic coating of appropriate thickness directly applied to the outer surfaces of the permanent magnet. The lower non-ferromagnetic cup, which will be exposed when the fastener is applied to an article, may preferably be formed of a molded plastic, suitably color coordinated or decorated in accordance with particular aesthetic requirements. It may also include flux blocking particles embedded therein for additional magnetic insulation.

Various arrangements are disclosed for assembling the individual parts forming the female member. They may include a rivet, which extends between aligned openings. Alternatively, cooperating projections and recesses may be provided to mechanically interfit the parts forming the female member, thereby dispensing with the need for a rivet.

In several of the embodiments the lower non-ferromagnetic cup-like member, which may typically be formed of plastic, will be snap fit onto the unit after the assembly of its components. This will permit customized selection of the aesthetics (e.g. color) according to the particular material to which the magnetic fastener is being attached. As shown in the various embodiments, the heights and thicknesses of the peripheral walls of the two cup-like non-ferromagnetic members which enclose the permanent magnet and its associated planar ferromagnetic member, may be varied. Further, the location of the cup-like members may be interchanged. That is, either of the upper or lower cup-like member may be positioned closer to the outer periphery of the permanent magnet, with the peripheral wall of the other cup-like member being exterior thereof, and defining the exterior peripheral wall of the female assembly.

It is therefore a primary object of the present invention to provide a magnetic fastener having non-ferromagnetic material about a significant peripheral portion of the permanent magnet.

Another object is to provide a thickened, preferably double, layer, of non-ferromagnetic material in selected areas about the periphery portion of the permanent magnet.

A further object is to provide such a magnetic fastener in which the enhanced thickness of non-ferromagnetic material to provide the requisite magnetic insulation, is achieved by two cup-like non-ferromagnetic members which are inverted with respect to each other, and enclose the permanent magnet.

Yet another object of the present invention is to provide such a magnetic fastener in which the exteriorly located non-ferromagnetic member is formed of a material which may be appropriately colored to provide aesthetic compatibility with the intended article to which the magnetic material will be attached.

Yet a further object of the present invention is to provide such a magnetic fastener in which at least a portion of the non-ferromagnetic exterior can be provided by use of a plastic member.

Still a further object of the present invention is to provide a magnetic fastener in which the individual parts forming the female member are in snap fit engagement, thereby avoiding the need for a fastening rivet.

Still another object of the present invention is to provide such a magnetic fastener in which the plastic member forming the exterior non-ferromagnetic cover may be snap fit onto the previously assembled parts of the female member.

These as well as other objects of the present invention will become apparent upon a consideration of the following detailed description and drawings.

BRIEF DESCRIPTION OF THE DRAWINGS

FIG. 4 is a cross-sectional view of a modification of the assembly shown in FIG. 3 in which the outermost wall of the non-ferromagnetic enclosure member has been increased in height.

FIG. 5 is a further modification, generally corresponding to FIG. 3, but with the outermost cup-like member snap fit over the previously assembled portions of the female member.

FIG. 6 is an enlarged detail of the portion shown as "X" in FIG. 5, showing a typical manner in which the outermost non-ferromagnetic cup-like member, may be mechanically retained.

FIGS. 7 and 8 are additional embodiments showing further modifications of the female member assembly.

FIGS. 18, 19 and 22 show the inclusion of a secondary ferromagnetic pierced planar member for central flux focusing.

Figure 1:
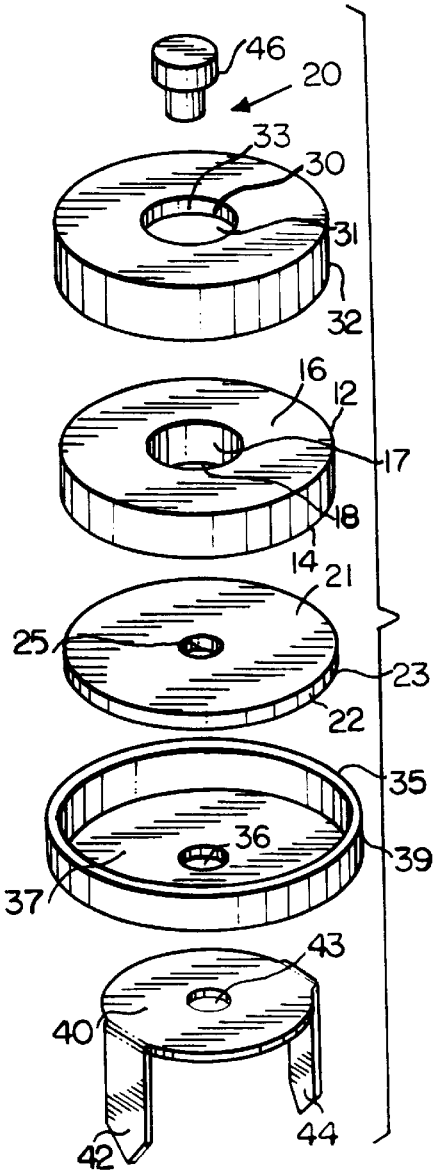
FIG. 1 is an exploded perspective view of one form of the female member portion of a magnetic fastener in accordance with the present invention.
Figure 2:
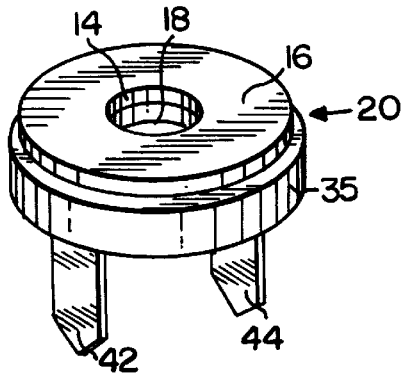
FIG. 2 is a perspective view of the assembled female member portion.
Figure 3:
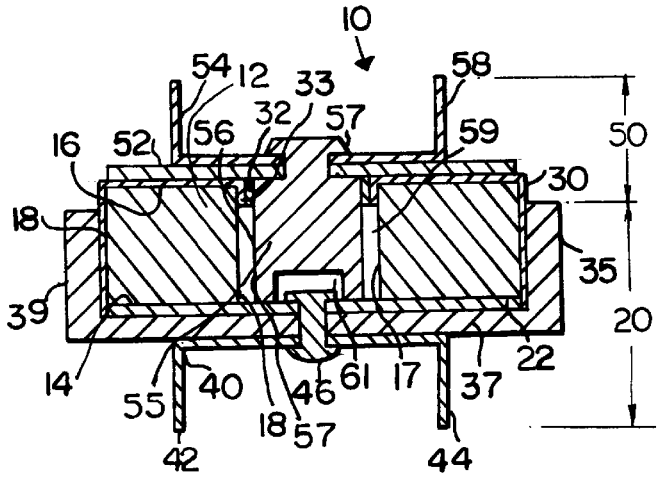
FIG. 3 is a cross-sectional view of the magnetic fastener shown in FIGS. 1 and 2, and further showing the cooperating male fastener unit.

Reference is now made to FIGS. 1–3 which show a first embodiment of the magnetic fastener 10. Although shown as round, other shapes, for example oval or square, are contemplated. The fastener includes a female member 20 and male member 50, which are shown in cooperative engagement in FIG. 3. Magnetic fastener 10 is of the type which finds particular utility as a handbag fastener in which the female member 20 is fastened to the main body portion of the handbag (not shown), while male member 50 is fastened to the closure of the lap (not shown) of the handbag. When the handbag is closed, the male member 50 is engaged with the female member 20 as shown in FIG. 3. When the bag is opened, the male member 50 and female member 20 are separated. As the bag is closed and the members 20–50 are brought into proximity, the magnetic forces of attraction between members 20 and 50 will facilitate the aligned inter-engagement of members 20 and 50 as shown in FIG. 3.

The female member 20 includes a permanent magnetic 12 which is illustratively shown as having an annular shape. Female magnet 12 includes opposed pole surfaces 14, 16, and a central opening 18 which extends between the opposed pole surfaces 14, 16. Central opening 18 includes a cylindrical wall 17. A planar ferromagnetic member 22 having opposed surfaces 21, 23 is secured to the magnet member 12, with its planar surface 21 positioned against the polar surface 14. Planar ferromagnetic member 22 in this embodiment is in the general form of a washer, including a central opening 25, the purpose of which will be subsequently discussed. Ferromagnetic member 21 is formed of a material which will be attracted to the permanent magnet 12, such as iron, cobalt, nickel, and alloys thereof. The magnet 12 is protectively enclosed and magnetically insulated, by the combination of upper cover member 30 and lower cover member 35. In accordance with the present invention, both the members 30 and 35 are formed of non-ferromagnetic material. While cover member 30 as shown as a separate integral element, which may typically be formed of brass, alternatively it may be a coating of the non-ferromagnetic film applied to the appropriate exterior surfaces of magnet 12. Such a material, which may be sprayed or plated onto the magnet 12, may typically be a polymer or appropriate epoxy. Further, cover 12 may be an integral plastic member which may be embedded with flux blocking particles 235 as shown in FIG. 14A, which may be zinc, or zinc/nickel composites in order to provide a more effective magnetic shield against the tendency of the flux path to radiate outward from magnetic fastener 10.

The cover member 30 includes a central opening 31 which is of a diameter such that when the cover member 30 is positioned over the polar face 16, the cover member 30 overlies the polar face 16 except for a portion of the central opening 18 of permanent magnet 12. According to this embodiment, the cover member 30 also includes a depending annular lip 33 about the circumference of opening 31 which will extend along the uppermost portion of the central opening 18 of the magnet 12. This lip, as will be subsequently discussed, and as shown in FIG. 3, prevents the central projecting ferromagnetic portion 55 of the cooperating male member 50, from contacting the inner walls 18 of the magnet 12, which would disadvantageously result in a short circuit within the magnetic path. Where the lip 33 is provided, an air gap 32 will preferably be included between the outer surface of the lip 33 and the side wall of projecting portion 55 of the male member 50 to deter an inadvertent erroneous magnetic circuit closure. Alternatively, as will be subsequently discussed in conjunction with FIG. 7 below, the lip 33 may be dispensed with, preferably by making the opening 31 of cover member 30 sufficiently less than the diameter of magnet central opening 18, so as to likewise prevent the projecting male member 55 from contacting the inner walls 17 of the magnet member 12.

Cup-like member 35 can be formed of any suitable non-ferromagnetic material. It is preferably formed of a plastic which, as will be subsequently described, can provide a variety of desirable aesthetics, to what had been previously been presented to the consumer as a metal, typically brass colored, closure. For example, the plastic material of member 35 can be appropriately color coordinated to the handbag, or other article to which the magnetic fastener is to be secured. Alternatively it can include the descriptive logo of the handbag manufacturer. The plastic forming cup-like member 35 may also preferably include flux blocking particles embedded therein, such as zinc, or zinc nickel composite. Cup-like member 35 includes a planar portion 37 which overlies planar surface 22 of the ferromagnetic member 21, and an upwardly extending wall 39 which covers at least the lower portion of the outer peripheral wall 18 of magnet 12. In the well known manner, attachment means 40 is provided. Commonly this includes bendable prongs 42, 44 at the lowermost extreme of the female member 20, for attaching the same to the handbag, or other article intended for receiving the magnetic fastener. A fastener element 46, which may typically be a ferromagnetic (e.g. steel) or non-ferromagnetic rivet (e.g. brass, aluminum or plastic), extends through aligned opening 43, in the fastener element 46, 36 in the cup-like, non-ferromagnetic member, and 25 in the planar ferromagnetic member for securing these parts together as an integral assembly.

The side wall 39 of cup-like member 35 may be varied in height. For example, FIG. 4 shows a variation of the assembly shown in FIG. 3, wherein the height of side wall 39 has been increased to extend above upper member 12. Likewise, the thickness of the material forming the cup-like member 30 can be varied.

Permanent magnet 12 is enclosed by the non-ferromagnetic material of enclosure members 30 and 35. Preferably at least a substantial portion of the circumferential wall of magnet 12 will have two layers of non-ferromagnetic insulation as provided by the overlapped peripheral walls 32, 39. This double insulation serves to effectively tightly confine the magnetic flux path within female assembly 20, thereby inhibiting escaping magnetic flux which could deactivate the magnetic strip of credit cards carried within a handbag bearing the fastener.

In addition to providing this functionally enhanced magnetic insulation, the cup-like member 35, which can be formed of plastic, can be provided in a variety of colors and shapes, so as to enhance the aesthetics of the fastener, and in particular the female portion thereof when secured to the body of the handbag. Further, the plastic material forming cup-like member 35 will be devoid of sharp edges, which is particularly advantageous when the fastener is to be connected to leather or delicate fabrics.

The cooperating male member 50 includes a ferromagnetic planar member 52 which may be of the same material as the planar ferromagnetic member 30 of the female member. It also includes a fastening element 54, having prongs 56, 58, which generally corresponds to fastening element 40 of the female member. The male member further includes a central projecting ferromagnetic portion 55 which is configured to enter into the central opening 18 of the magnet. The outer circumference of projecting portion 55 is less than the inner circumference of magnet opening 18 so as to provide an air gap 59 therebetween. Lip 33 of the cover member 30 (or a suitably restricted opening 31, as shown in FIG. 7) limits the lateral movement of the male member 50, so as to prevent the side walls 57 of the projection 55 from contacting the interior sidewalls 17 of the magnet. The projecting portion 55 of the magnet will be of sufficient length such that its forward extreme will contact the planar surface 21 of the ferromagnetic member 22. A cutout 61 is preferably provided at the forward end to accommodate the top of rivet 46, while permitting the forward end of the projection 55 to contact ferromagnetic planar surface 21. The opening 61 within the central portion of the forward end of projection 55 also advantageously serves to focus the flux around and outside the periphery of the projection 55. A rivet type head 57 is provided integral with the projecting member 55 for securing the planar portion 52, and fastening element 54 thereto.

Reference is now made to FIG. 4, which shows a modified embodiment of the magnetic fastener shown in FIGS. 1–3, and in which like parts are similarly designated. This embodiment differs in that the upper peripheral extent of wall 39 of the non-ferromagnetic cup-like member 35 is longer, as shown by the length X, such that it extends above both the upper planar surface of the non-ferromagnetic cover member 30 and the ferromagnetic planar member 52 of the male member. If desired, the additional wall length X may be reduced such that the wall portion 39 terminates at the upper extent of the cover member 35. In addition to the aesthetic advantage of providing a complete enclosure by cup member 35, which may be formed of a suitably colored or otherwise decorative plastic member, this embodiment provides a dual layer of non-ferromagnetic material along the entire peripheral wall 18 of the magnet member 12.

FIGS. 5 and 6 show still another embodiment of the present invention in which the cup-like member 35-1 is devoid of a central section between fastener 40 and ferromagnetic planar member 22. It is in the form of an annular member which may be press fit over the other elements forming the female member, either before or after their assembly by rivet 46. Member 35-1 in this embodiment may typically be formed of a plastic which is force fit over cover member 30, so as to be frictionally retained thereon. If desired, as shown in FIG. 6, interengaging projections 70 may be provided about the outer periphery of cover member 30, which will fit in complementary recesses 71 along the inner periphery of cup-like member 35. This embodiment readily permits the modification of the female assembly to accommodate differently colored or otherwise decorated non-ferromagnetic parts 35, so as to provide enhanced coordination in conjunction with the handbag or other article with which the magnetic fastener is being secured.

Reference is now made to FIG. 7 which shows still a further embodiment of the present invention, and in which like components are similarly numbered. Corresponding components which are being altered in the present embodiment are indicated by prime numbers. This embodiment differs from that shown in FIGS. 1–3 in two respects. (1) The sequential location of the non-ferromagnetic cover member 30' and cup-like member 35' have been reversed; that is, cup-like member 35' is positioned closer to the magnet 12, with cover member 31' being external thereof. As in the prior embodiments, parts 30' and 35' define a dual layer of non-ferromagnetic material, to provide a double layer of insulation along a portion of the outer peripheral wall 18 of the magnet 12. (2) The lateral movement of the male member 50 to prevent the side walls 56 of the male projection 55 from contacting the interior wall 18 of the magnet is not provided by a downwardly turned lip, as shown by 33 of FIGS. 3–5. Instead, the opening 31' of the cover member 30 is sufficiently smaller than the diameter of the central magnetic opening 18, and generally corresponds to the circumference of male projection 55, so as to restrain the male projection 55 from a lateral movement into engagement with the side walls 18 of the magnet. This circumferential difference advantageously also serves to maintain air gap 59.

Figure 8:
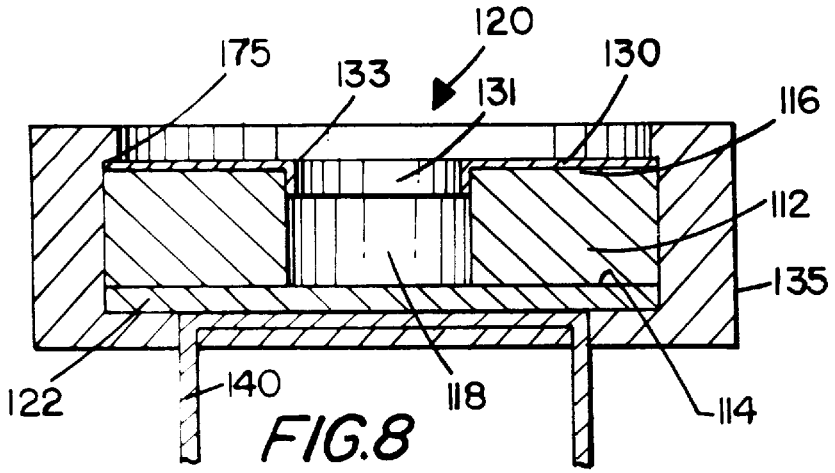

FIG. 8 shows still a further embodiment of the female fastening member, in which those components which functionally correspond to those of the prior embodiments are indicated with 100 prefixes. The female assembly 120 includes the circular magnet 112 having opposed pole 114, 116 and central opening 118. The washer type ferromagnetic planar member 122 does not include a central opening. It is positioned against polar face 114. Non-ferromagnetic cover member 130 is positioned against opposed polar face 112. Non-ferromagnetic cover member 130 includes an annular lip 133. An outer non-ferromagnetic cup-like member 135, which has a fastener member 140 embedded therein, encloses the bottom and side walls of the female member. Cup member 135 is advantageously formed of a plastic material, suitably colored or decorated in accordance with its particular application and may include additional flux blocking particles 235 (FIG. 14A) embedded therein. The thickness and material forming cup-like member 35, which covers the entire outer peripheral wall of magnet 112 and outer circumferential lower area of magnet 112 and ferromagnetic member 122, is selected to provide appropriate magnetic insulation of the female member assembly 120. A lock ring lip 175 is provided to engage the outer periphery of non-ferromagnetic cover member 130, which serves to hold the parts 130, 112, 122 and 140 together as an integral assembly. It is to be noted that this assembly does not require a rivet, such as 46, in the prior embodiments, for assembling the various parts of the female member.

FIGS. 9–12 show various additional configurations of the male portion of the magnetic fastener which may be utilized in conjunction with the several embodiments of female member constructed in accordance with the present invention. All of these male assemblies include a ferromagnetic planar member 52, double pronged fastener member 54, and a central projecting ferromagnetic portion 55-1, 55-2, 55-3, respectively. All the projecting portions have the following common features: (a) They are of appropriate length such that their free forward end will contact the planar surface of the above discussed female ferromagnetic member 22 or 122. (b) They include central openings 61-1, 61-2, 61-3, respectively, which serve to avoid contact with rivet 46 and focus the flux around the outside periphery of the respective male projecting portion. (c) The circumference of the male projecting portion is sized, as shown in FIG. 3, so that an air gap will be provided between its periphery and lip 33 or 133, with the lip 133 preventing the side walls of the projection from contacting the inner walls of the magnet opening 18 or 118, so as to avoid a magnetic short circuit.

Figure 12:
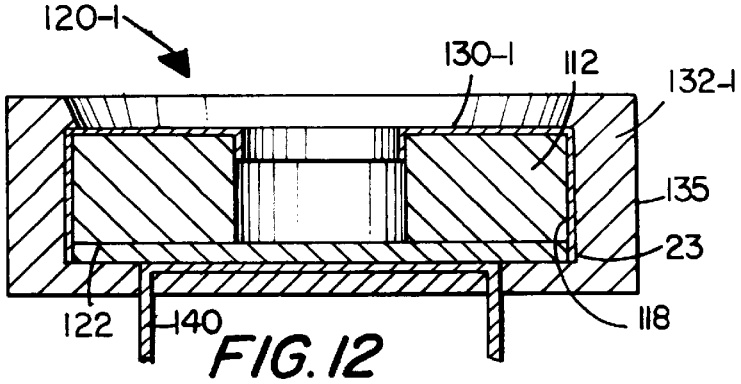
FIGS. 12–23 show further modifications of the female member assembly in accordance with the present invention, with FIG. 14 depicting the typical manner in which flux blocking particles may be embedded within one of the non-ferromagnetic closure members.

FIG. 12 shows a further embodiment 120-1 of the female member assembly, generally corresponding to FIG. 8, but wherein the non-ferromagnetic cover member 130-1 includes downwardly extended circumferential walls 132-1 which are coextensive with both the outer peripheral walls 118 of magnet 112 and 23 and the ferromagnetic planar member 122. Accordingly, a double layer of insulation will be provided along the entire periphery of magnet 112 and ferromagnetic member 122, with the entire bottom surface of the female member assembly 120-1, except for the protruding prongs of the attachment means 140, being covered by the cup shaped nonferromagnetic member 135. Non-ferromagnetic member 135 may be formed of a suitable plastic, which, if desired, may include flux blocking particles embedded therein, as well as coloring to be aesthetically coordinated with the handbag or other article to which it is to be fastened.

Figure 13:
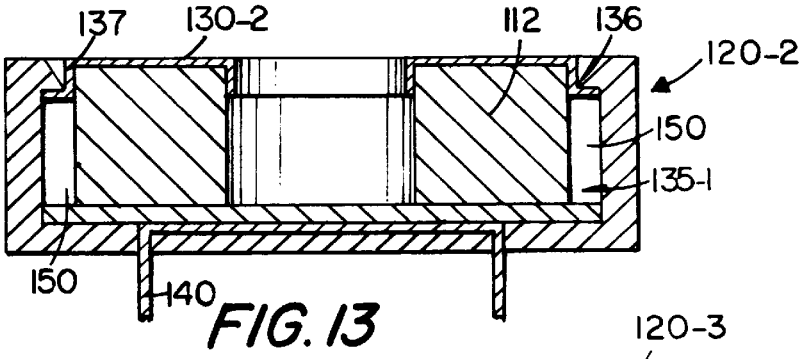

FIG. 13 shows still a further embodiment of the female member assembly 120-2, in which the depending peripheral wall of cup-like member 135-1 is narrowed to provide an air gap 150. The outer peripheral configuration of non-ferromagnetic cover member 130-2 includes a stepped projection 137 to mate with and be mechanically connected to the inwardly extending complementary projection 136 of the cup-like member 135-1 to maintain the assembly.

Figure 14:
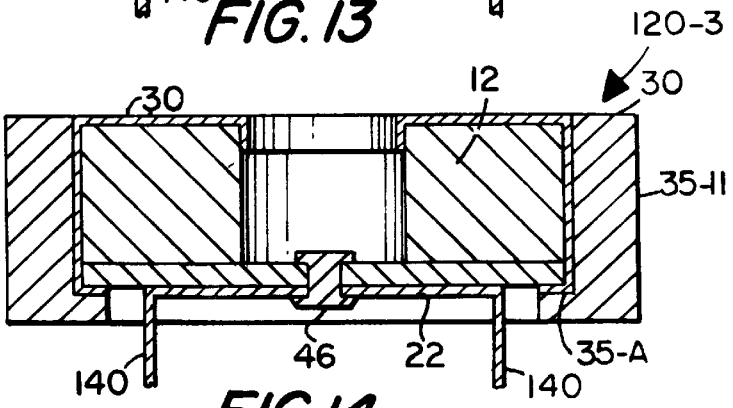
Figure 14A:
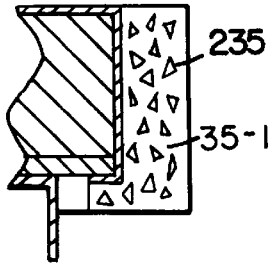

Reference is made to FIG. 14 which shows another modification of the female member in which the cup-like member 35-11 is in the form of a ring which can be snapped over the previously assembled portions of the female member. This unit varies from that shown in FIG. 8 in that: (a) The upper extent of the wall of ring like member 35-11 is now flush with the top of the entire assembly, and its lower inner annular extent, as shown by 35-A, does not fully extend to the attachment means 40, in order to provide appropriate clearance for manufacturing variations.

FIG. 14A shows a portion of the non-ferromagnetic snap on ring like cup 35-1, which is formed of plastic, and includes flux blocking particle 235 embedded therein. Such flux blocking particles impart a greater degree of magnetic insulation to the ring like member 35-1, and may typically include zinc, or a zinc nickel composite.

Figure 9:
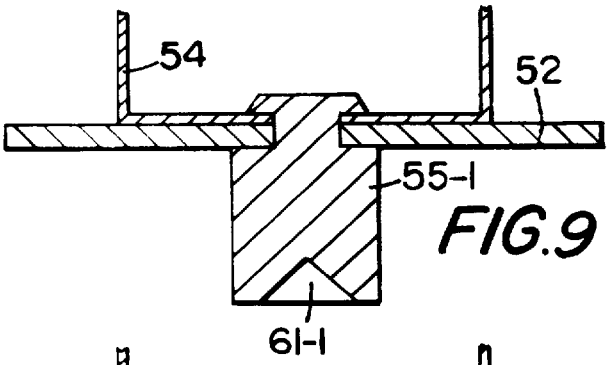
FIGS. 9–11 depict various modifications of the male member assembly.
Figure 10:
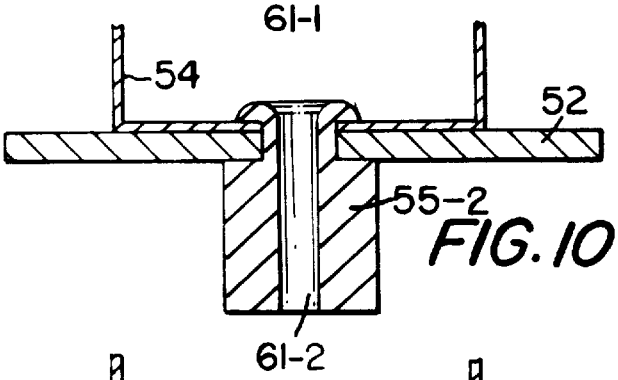
Figure 11:
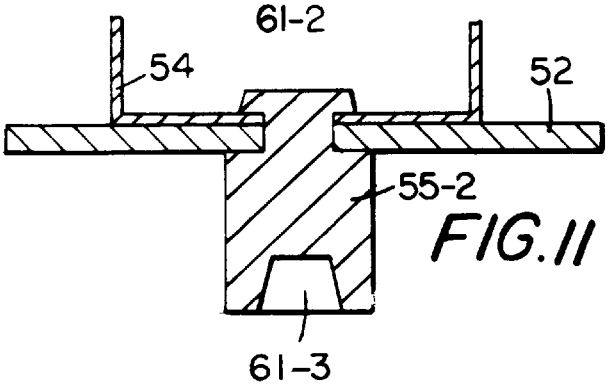
Figure 15:
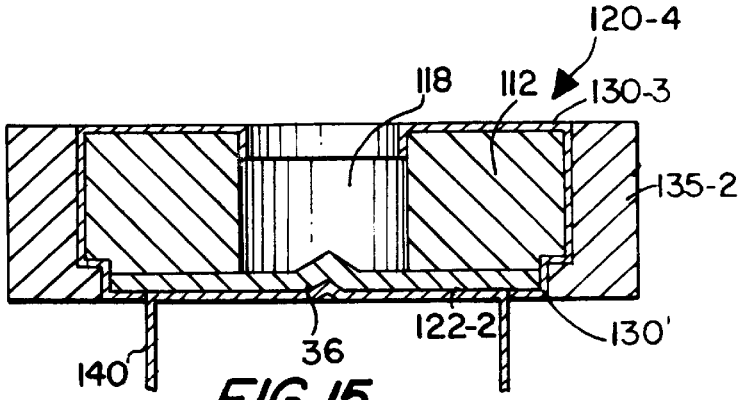

Reference is now made to FIG. 15, which shows a further embodiment of the female member assembly 120-3, where the outer non-ferromagnetic member 135-2 is also in the form of a ring, which may be peripherally decorative and snap fit in place, and is frictionally retained on the assembly. The planar ferromagnetic member 122-2 shown in this embodiment is retained by the stepped down and inwardly extending configuration 130' of non-ferromagnetic cover member 130-3. The ferromagnetic member 122-2 includes a centering protrusion 136, which is illustratively shown as triangular, but may be of other shapes. The male member assemblies, as shown in FIGS. 9 and 11 may typically be used in conjunction with female member assembly 120-3, with a suitable clearance being provided between the upwardly extending protrusion 136 and lower recess 61-1 or 61-3 (of FIGS. 9 and 11, respectively) to advantageously focus the flux around the outside perimeter of the male protrusion when it is centered within opening 118 of the permanent magnet 112.

Figure 16:
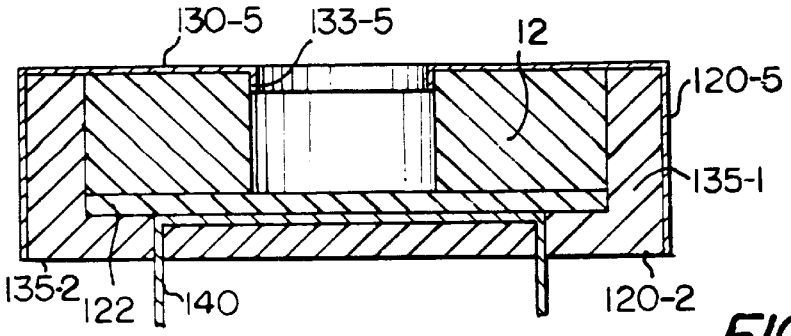

FIG. 16 shows still a further embodiment of the female member 120-5, in which the location of the non-ferromagnetic members 135-1 and 130-5 have been reversed. Member 130-5 is shown exterior to member 135-1. Cover member 130-5 may typically be formed of brass and includes a depending annular lip 133-5 externally extending prongs 120-2 which snap into a cooperating peripherals recess 135-2 for holding the assembly together.

Figure 16A:
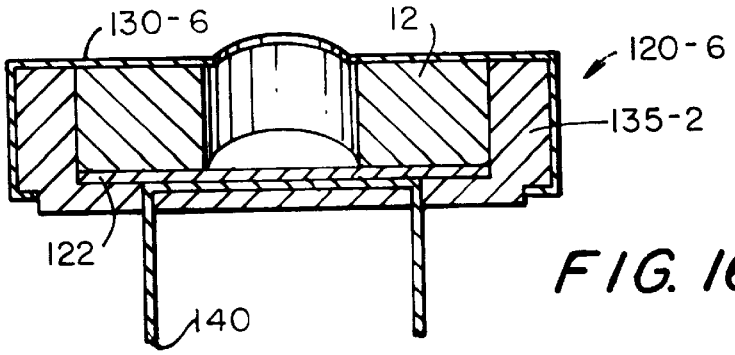

FIG. 16A shows a modification 120-6 of the female member shown in FIG. 16. Specifically: (1) the cuplike non-ferromagnetic member 135-2 is significantly thicker than member 135-1, and (2) the non-ferromagnetic cover member 130-6 does not include a depending annular lip extending into the central opening of magnet 12, as is shown by lip 133-5 of magnetic member 120-5.

Figure 17:
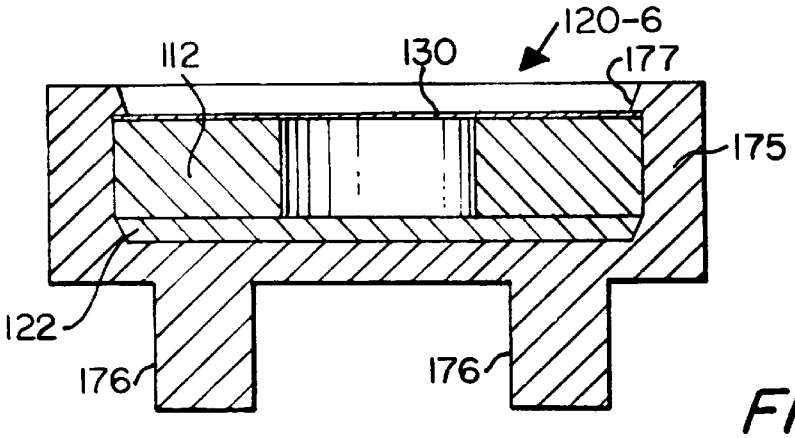
Figure 21:
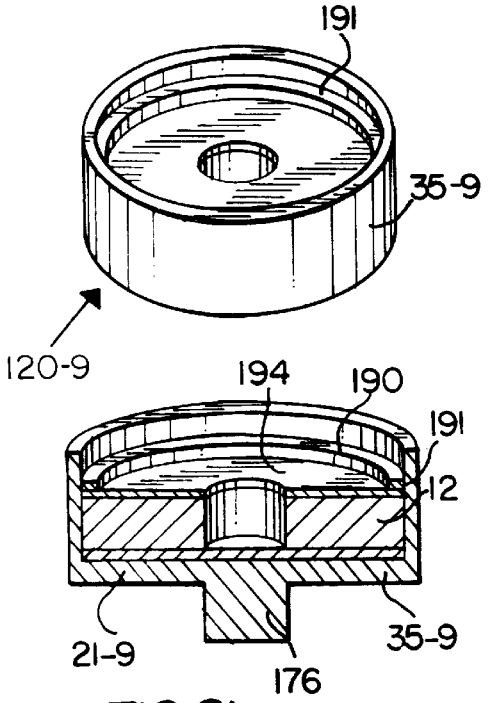

FIG. 17 shows still a further embodiment of female member assembly 120-6 in which the complete exterior of the assembly, including the fastening means, is formed of non-ferromagnetic member 175, which may preferably be molded plastic. Member 175 will be formed of a material and of sufficient thickness to provide the desired increased magnetic insulation comparable to that obtained with the double non-ferromagnetic layers of the above discussed embodiments. Planar ferromagnetic member 122, magnet 112, and non-ferromagnetic cover plate 130 are all placed within the central opening of non-ferromagnetic member 175, and held in place by lip 177. If desired, an appropriate adhesive may also be added in order to secure the female assembly 120-6. Mounting pins 176 are integral with member 175 and extend downward. To install the assembly 120-6, typically on a handbag, mounting pins 176 are inserted within complementary openings in the handbag, a washer (not shown) is inserted over the forward ends of the mounting pins 176, against the handbag material, and the mounting pins are then spread out in rivet like fashion. Although two mounting pins are shown, a single mounting pin (as shown in FIG. 21), may be used.

Figure 19:
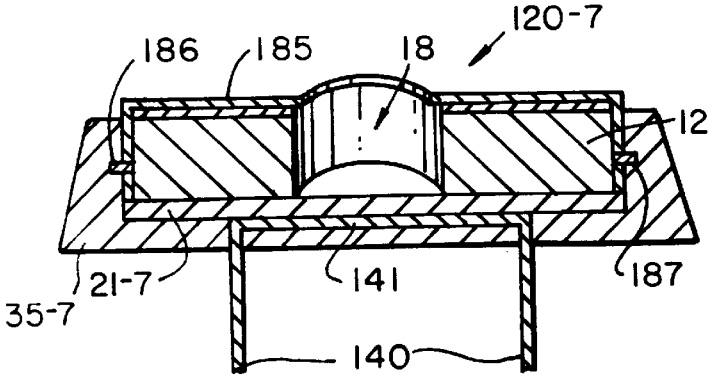
Figure 18:
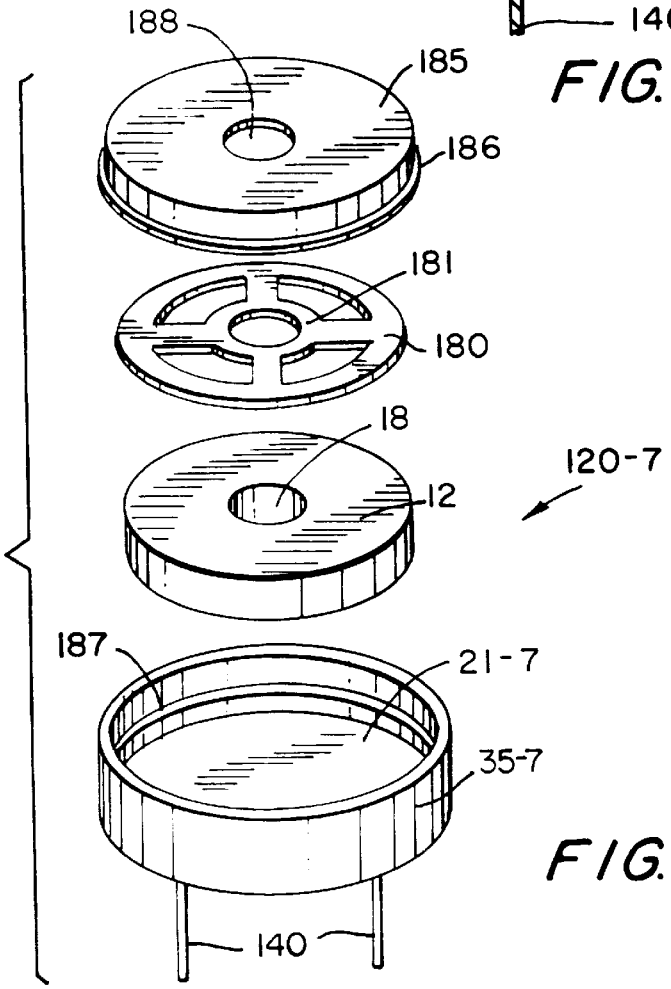

FIGS. 18 and 19 show still a further embodiment of the female member 120-7. Non-ferromagnetic cup member 35-7, which may typically be formed of brass, is preferably of gradually increased thickness towards its bottom extreme, as shown in the cross-sectional view of FIG. 19. Such increased thickness advantageously provides the requisite degree of magnetic insulation in accordance with the objectives of the present invention. A planar ferromagnetic member 21-7 is placed against the lowest surface of cup member 35-7, with magnet 12 placed thereon. A prong mounting plate 141, including individual prongs 140, is also provided for securing the assembly 120-7 to its intended article (e.g., handbag). Prong mounting plate 141 may be held in place by either the cup 35-7 or ferromagnetic plate 21-7. Advantageously, a secondary ferromagnetic pierced focused washer 180 is provided against the upper polar face of ferromagnetic member 12. Member 180 serves to focus the magnetic flux towards the center of the assembly, which both strengthens the magnetic attraction of the complementary male member (not shown) and reduces the tendency of the magnetic flux to stray outside of the fastener volume. In the assembled condition, central opening 181 of the washer 180 and 188 of cover member 186 will be in alignment over central opening 18 of the magnet 12, so as to permit the entry of the central projecting ferromagnetic portion of the male magnet assembly (not shown). It is to be noted that while the embodiment shown in FIGS. 18 and 19 does not include a central annular lip extending from the cover member 185 into the magnet opening 18, the assembly may be modified to include such a lip.

In accordance with a particularly advantageous aspect of this invention, the non-ferromagnetic cover member 185 includes a circumferentially outwardly extending lower lip 186 which is received in internal circumferential groove 187 of cup member 35-7. Thus, to assemble the individual components forming the female member 120-7, prong mounting plate 141, ferromagnetic planar member 21-7, magnet 12, and secondary ferromagnetic pierced focused washer 180 are successively placed within the cup member 35-7. Cover member 185 is then located over this assembly, and moved downward until locking lip 186 is snap fit engaged within its complementary groove 187. Thus the entire assembly does not require rivets or other fastening members.

Figure 20:
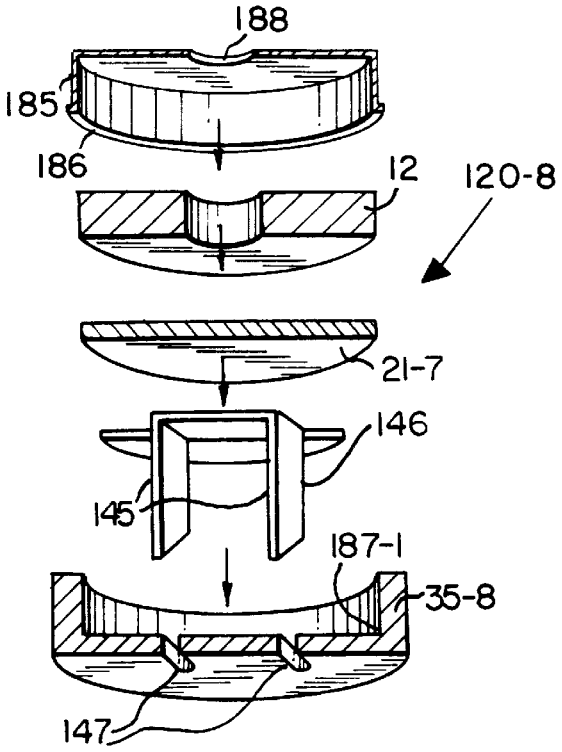

Reference is made to FIG. 20 which shows still another embodiment 120-8 of the female magnetic assembly, shown in exploded perspective, and partial cross section. Parts 185, 12, and 21-7 correspond to like numbered parts in the embodiment shown in FIGS. 18 and 19. If desired, the secondary ferromagnetic pierced focused washer, such as 180, shown in the embodiments of FIGS. 18 and 19, may be added. This embodiment differs from the embodiment shown in FIG. 20 with respect to the manner in which the mounting prongs 145 are provided. The mounting prongs 145 are integral with a prong mounting plate 146. The non-ferromagnetic cuplike member 35-8, which provides the requisite magnetic insulation, includes downwardly bent extensions 147 which are located to receive the prongs 145, and lock them in place. The non-ferromagnetic cup member 35-8 also includes groove 187-1 which receives lock ring lip 186 of the non-ferromagnetic cover member 185, in snap fit engagement for final assembly of the female magnetic member 120-8.

Reference is now made to FIG. 21 which shows still another embodiment 120-9 of the female magnetic assembly which utilizes a lock ring washer 190 which engages a complementary circumferential recess 191 within the non-ferromagnetic cup member 35-9. As is shown in this figure, the connecting prong 176 is an integral part of the cup member 35-9, and generally corresponds to that part shown in FIG. 17. Accordingly, the fastener 120-9 may be easily assembled by successively placing planar ferromagnetic member 21-9, and magnet 12, within the non-ferromagnetic cup member 35-9. The lock ring washer 190 is thereafter snap fit into engagement with groove 191.

Figure 22:
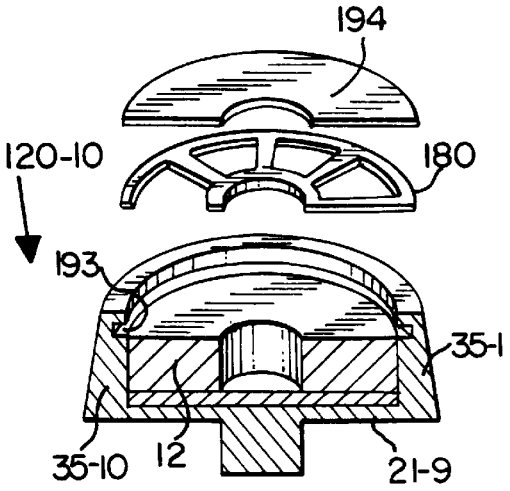

Reference is now made to FIG. 22 which shows a modification of FIG. 21, in which the pierced ferromagnetic flux focus plate 180 is included and a planar non-ferromagnetic cover member 194 will snap lock into internally grooved recess 193 of the non-ferromagnetic cup member 35-10 for final assembly. To provide increased magnetic insulation, magnetic cup member 35-10 may be of gradually increasing thickness towards its bottom surface, as is similarly shown in the embodiment of FIG. 19.

Figure 23:
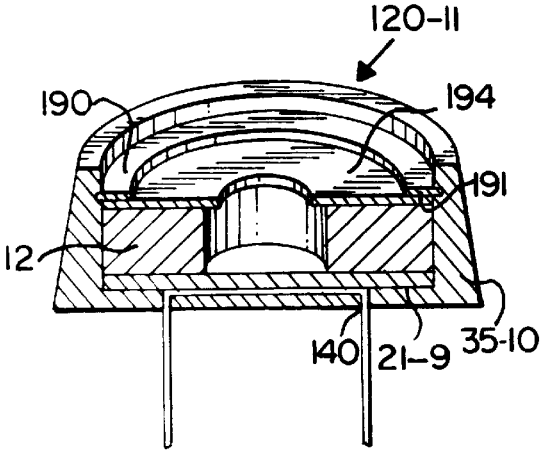

Reference is now made to FIG. 23 which shows another embodiment 120-11 which generally corresponds to FIG.

21. It is to be noted that the ferromagnetic planar member 21-9, magnet 12, and planar non-ferromagnetic cup member 194 are assembled by lock spring washer 190 within complementary groove 191 of the non-ferromagnetic cup member 35-10. In this embodiment, prongs 140, generally corresponding to similarly numbered prongs of FIG. 19, are utilized. Further, the thickness of the non-ferromagnetic cup member 35-10 gradually increases towards its bottom extreme, as shown in FIGS. 19 and 22, to provide increased magnetic insulation.

Figure 24:
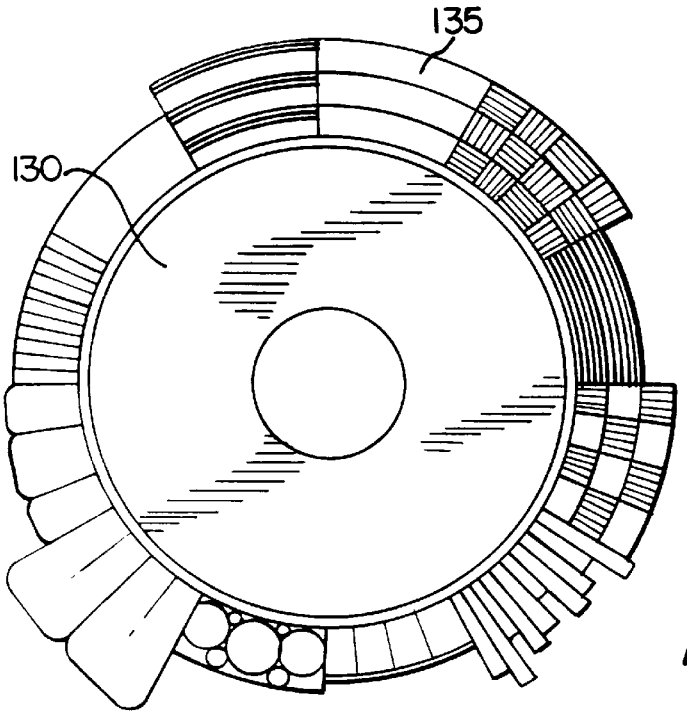
FIG. 24 shows representative decorative effects which may be provided about the outermost non-ferromagnetic enclosure member of the female member assembly.

FIG. 24 illustratively shows various decorative surface configurations that may be placed about the molded plastic non-ferromagnetic cover member 135 (as typically shown in FIG. 8). In addition to the appropriate selection of color, the cover member 135 may include a variation in texture or patterns to provide the desired aesthetic effect or an identification of the handbag manufacturer. It should likewise be understood that such surface configurations may similarly be applied to the other embodiments shown in the figures.

While the present invention has been disclosed with reference to specific embodiments and particulars thereof, it is intended that the invention be defined by the following claims:

I claim:

1. A magnetic fastener including manually separable male and female members:

said female member including a permanent magnet having first and second poles at its opposite faces, a central opening interiorly extending between said first and second pole faces, and a peripheral wall exteriorly extending between and separating said first and second pole faces;

a first substantially planar ferromagnetic member having opposed first and second surfaces, with said first surface positioned against at least a portion of said first pole face;

a cover member including a first planar portion having an interior surface overlying said second pole face except for a portion of said central opening and a second depending wall portion overlying at least a portion of the peripheral wall of said magnet which separates said second pole face and said first pole face;

non ferromagnetic material at the exterior of said female member including a first planar portion covering at least a portion of the outer area of the second surface of said first ferromagnetic member, and an upwardly extending wall portion covering at least a portion of the magnet peripheral wall extending from said first pole face towards said second pole face, and said male member including a ferromagnetic planar portion configured for magnetic engagement against the exterior of said cover member planar portion, and a central projecting ferromagnetic portion configured to enter said central opening for magnetic attraction towards and contact with said first ferromagnetic member.

2. A magnetic fastener according to claim 1, wherein said non-ferromagnetic exterior material comprises a unitary cup like member including said planar portion and an upwardly extending wall portion.

3. A magnetic fastener according to claim 2, wherein said unitary cup like member is formed of plastic.

4. A magnetic fastener according to claim 1, wherein said cover member is formed of non-ferromagnetic material.

5. A magnetic fastener according to claim 4, wherein said cover member and non-ferromagnetic exterior material enclose substantially the entire exterior surfaces of said magnet with non-ferromagnetic material.

6. A magnetic fastener according to claim 5 wherein said non-ferromagnetic exterior material comprises a unitary cup like member including said planar portion and upwardly extending wall portion.

7. A magnetic fastener according to claim 6, wherein said unitary cup like member is formed of plastic.

8. A magnetic fastener according to claim 7, which further includes flux blocking particles distributed within the plastic of said unitary cup-like member.

9. A magnetic fastener according to claim 1, wherein said non-ferromagnetic exterior material comprises a unitary cup like member including said planar portion and upwardly extending wall position;

said cover member is formed of non-ferromagnetic material; and said unitary cup like member and cover member enclose substantially the entire exterior surfaces of said magnet with non-ferromagnetic material.

10. A magnetic fastener according to claim 9, wherein at least a portion of the depending wall portion of said cover wall portion and said cup-like member wall portion overlap along the peripheral wall of said magnet, to provide a double layer of non-ferromagnetic material along said overlapped wall portions.

11. A magnetic fastener according to claim 9, wherein said cover member includes an outwardly extending circumferential lip, and said unitary cuplike member including an inner circumferential groove adapted to receive said circumferential lip in snap fit engagement.

12. A magnetic fastener according to claim 10, wherein said cover wall portion is closer to said magnet wall portion than the wall portion of said cup like member, with said cup-like member forming the outermost surfaces of said female member.

13. A magnetic fastener according to claim 12, wherein said unitary cup-like member is formed of plastic.

14. A magnetic fastener according to claim 13, which further includes flux blocking particles distributed within the plastic of said unitary cup-like member.

15. A magnetic fastener according to claim 10, wherein, an air gap is provided between the peripheral walls of said magnet and said cover member.

16. A magnetic fastener according to claim 1, wherein an air gap is provided between the interior walls of said magnet central opening and the projecting portion of said male member.

17. A magnetic fastener according to claim 1, further including a pierced magnetic planar member between said cover member and second pole face.

18. A magnetic fastener including manually separable male and female members:

said female member including a circular permanent magnet, a substantially planar ferromagnetic member and first and second cup-like non-ferromagnetic members;

said circular permanent magnet having first and second poles at its opposite faces, a central opening interiorly extending between said first and second poles, and a peripheral wall exteriorly extending between said first and second poles;

said ferromagnetic member having opposed first and second surfaces, with said first surface positioned against said first pole;

each of said first and second cup-like non-ferromagnetic members including a planar portion and a circumferential wall portion;

the planar portion of said first cup-like member positioned against said second pole, except for a portion of said central opening, and its circumferential portion extending along the peripheral wall of said magnet, towards said first pole;

the planar portion of said second cup-like member positioned against at least the outer annular area of the second surface of said ferromagnetic member, with its circumferential walls portion extending towards said second pole;

said male member includes a ferromagnetic planar portion configured for magnetic engagement against the exterior of said first cup-like member planar portion, and a central projecting ferromagnetic portion configured to enter said central opening for magnetic attraction towards and contact with said first planar ferromagnetic member.

19. A magnetic fastener according to claim 18, wherein said first and second cup-like members substantially enclose the exterior surfaces of said magnet with non-ferromagnetic material.

20. A magnetic fastener according to claim 18, wherein portions of the circumferential walls of said first and second cup-like member wall overlap along the peripheral wall of said magnet, to provide a double layer of non-ferromagnetic material along said overlapped wall portions.

21. A magnetic fastener according to claim 19, wherein portions of the circumferential walls of said first and second cup-like member wall overlap along the peripheral wall of said magnet, to provide a double layer of non-ferromagnetic material along said overlapped wall portions.

22. A magnetic fastener according to claim 18 wherein at least one of said cup-like non-ferromagnetic members is formed of plastic.

23. A magnetic fastener according to claim 22, wherein the plastic includes flux blocking particles.

24. A magnetic fastener according to claim 18, wherein one of said cup-like non-ferromagnetic members is inverted with respect to the others, with one of said cup-like non-ferromagnetic members inserted within the other, and said magnet is located within the innermost one of said cup-like non-ferromagnetic members.

25. A magnetic fastener according to claim 24, wherein an air gap is provided between the peripheral walls of said magnet and innermost cup like member.

26. A magnetic fastener according to claim 18, further including means for securing said planar ferromagnetic member to the interior planar surface of said second cup-like member.

27. A magnetic fastener according to claim 18, further including limit means for limiting the lateral movement between said male and female members.

28. A magnetic fastener including manually separable male and female members:

said female member including a permanent magnet having first and second poles at its opposite faces, a central opening interiorly extending between said first and second poles, and a peripheral wall exteriorly extending between said first and second poles;

a first substantially planar ferromagnetic member having opposed first and second surfaces, with said first surface positioned against said first pole;

a non-ferromagnetic enclosure exterior of and covering at least the outer peripheral walls and a portion of the poles of said permanent magnet;

a portion of said non-ferromagnetic enclosure including at least two layers of non-ferromagnetic material;

said male member includes a ferromagnetic planar portion configured for magnetic engagement against the exterior of said cover member planar portion, and a central projecting ferromagnetic portion configured to enter said central opening for magnetic attraction towards and contact with said first ferromagnetic member.

29. A magnetic fastener according to claim 28, wherein:

said two layers of non-ferromagnetic material cover at least the major potion of said magnetic peripheral wall.

30. A magnetic fastener according to claim 28, wherein:

said non-ferromagnetic and magnetic peripheral wall enclosure covers said first and second poles, with said two layers covering at least the major portion of said magnetic peripheral wall.

31. A magnetic fastener according to claim 28, wherein said non-ferromagnetic enclosure includes a plastic part which forms outermost exterior surfaces of said female member.

32. A magnetic fastener according to claim 31, wherein said plastic part is adapted to be manually snap fit over and frictionally retained by the other parts of said female member, said plastic part including manually defeatable retaining means for retaining said plastic part on said female member.

33. A magnetic fastener according to claim 31, wherein said plastic part includes flux blocking particles.

34. A magnetic fastener according to claim 29, wherein said two layers of non-ferromagnetic material covers at least the lower peripheral walls of said permanent magnet.

35. A magnetic fastener including manually separable male and female members:

said female member including a circular permanent magnet, a substantially planar ferromagnetic member and first and second non-ferromagnetic members;

said circular permanent magnet having first and second poles at its opposite faces, a central opening interiorly extending between said first and second poles, and a peripheral wall exteriorly extending between said first and second poles;

said ferromagnetic member having opposed first and second surfaces, with said first surface positioned against said first pole;

each of said first and second non-ferromagnetic members including a planar portion;

the planar portion of said first non-ferromagnetic member positioned against said second pole, except for a portion of said central opening;

said second non-ferromagnetic member having a cup-like shape, including a circumferential wall and an interior volume enclosed by its planar portion and circumferential wall;

the planar portion of said second cup-like member positioned against said second surface of said ferromagnetic member, with its circumferential wall extending towards said second pole and overlying the peripheral wall of said magnet;

said ferromagnetic member, magnet, and first non-ferromagnetic member sequentially located within the interior volume of said second non-ferromagnetic member;

retaining means for interconnecting said first and second non-ferromagnetic members and retaining said first ferromagnetic member, magnet, and first ferromagnetic member within the interior volume of said second non-ferromagnetic member to define the assembly of said female member; and said male member including a ferromagnetic planar portion configured for magnetic engagement against the exterior planar portion of said first non-ferromagnetic member, and a central projecting ferromagnetic portion configured to enter said central opening for magnetic attraction towards and contact with said ferromagnetic member.

36. A magnetic fastener according to claim 35, wherein said second non-ferromagnetic cup-like member is formed of plastic.

37. A magnetic fastener according to claim 36, which further includes flux blocking particles distributed within the plastic of said second non-ferromagnetic cup-like member.

38. A magnetic fastener according to claim 35, wherein said retaining means includes a recess along the upper inner circumferential wall of said second non-ferromagnetic member adapted to interfit with and retain a complementary exterior region of said first non-ferromagnetic member.

39. A mechanical fastener according to claim 38, wherein, the retaining means of said first and second non-ferromagnetic members are snap fit together for assembly of said female member.

40. A mechanical fastener according to claim 35, wherein said first non-ferromagnetic member has a cuplike shape, including a peripheral wall extending from its planar portion and overlying at least a portion of the peripheral wall of said magnet, and an outwardly extending circumferential lip at the terminus of its peripheral wall;

said second non-ferromagnetic cuplike member including an interior circular groove configured to receive said circumferential lip, whereby said retaining means is provided by the engagement of said circumferential lip within said circumferential groove.

* * * * *